US006645329B1

(12) United States Patent
Rafoss

(10) Patent No.: US 6,645,329 B1
(45) Date of Patent: Nov. 11, 2003

(54) SYSTEM AND METHOD OF INSTALLING TILES AND THE LIKE

(76) Inventor: John Rafoss, 2949 E. Hill Rd., N. Troy, VT (US) 05859

( * ) Notice: Subject to any disclaimer, the term of this patent is extended or adjusted under 35 U.S.C. 154(b) by 57 days.

(21) Appl. No.: 10/123,658

(22) Filed: Apr. 16, 2002

Related U.S. Application Data

(60) Provisional application No. 60/285,033, filed on Apr. 20, 2001.

(51) Int. Cl.[7] ..... B32B 31/00

(52) U.S. Cl. ..... 156/71; 156/299; 156/575; 156/578; 156/579

(58) Field of Search ..... 156/71, 297, 299, 156/574, 575, 578, 579

(56) References Cited

U.S. PATENT DOCUMENTS

| | | | | |
|---|---|---|---|---|
| 1,751,565 A | | 3/1930 | Talbot | |
| 1,833,582 A | | 11/1931 | Kavanagh | |
| 2,373,239 A | | 4/1945 | Fenn | |
| 2,645,986 A | | 7/1953 | Rasmussen | |
| 3,804,696 A | | 4/1974 | Lobmeier | 156/499 |
| 4,537,331 A | | 8/1985 | Matula | 222/165 |
| 5,254,167 A | | 10/1993 | Janoski et al. | 118/108 |
| 5,878,921 A | * | 3/1999 | Chase et al. | 222/333 |
| 5,947,346 A | | 9/1999 | London | 222/608 |
| 5,967,426 A | * | 10/1999 | McLeod | 239/662 |
| 6,382,922 B1 | * | 5/2002 | Lewis et al. | 417/38 |
| 6,484,782 B1 | * | 11/2002 | Lewis et al. | 156/578 |

FOREIGN PATENT DOCUMENTS

| | | |
|---|---|---|
| EP | 0471813 | 2/1992 |

* cited by examiner

*Primary Examiner*—James Sells
(74) *Attorney, Agent, or Firm*—James D. Welch

(57) ABSTRACT

Disclosed are a system and method for installing tiles and the like. The system allows for easily spreading mortar before installation of tiles or the like, and grout thereafter; and the method uses the same system for dispensing both mortar and grout with only minor modification thereto being required to optimize material spreading results.

14 Claims, 5 Drawing Sheets

SYSTEM AND METHOD OF INSTALLING TILES AND THE LIKE

This Application claims benefit of Provisional Application Ser. No. 60/285,033; filed Apr. 20, 2001.

TECHNICAL FIELD

The disclosed invention relates to systems and methods of construction, and more particularly to a system and method for installing tiles and the like, said system comprising means for easily spreading mortar before installation of tiles or the like, and grout thereafter; and said method comprising using the same system for dispensing both mortar and grout with only minor modification thereto being required to optimize the end results.

BACKGROUND

Homes and buildings have floors which are often covered with tiles and the like. Said floors are typically substantially flat and are formed by, for instance, interconnecting beams and plywood. Prior to laying tiles or the like in place on said flooring, a layer of adhesive is applied which serves to secure the tiles. Conventional procedure for applying said adhesive is slow, inefficient and labor intensive. In addition, after tiles or the like are put into place, grout is applied to fill there-in-between. Again, the conventional approach is slow, inefficient and labor intensive. It is established then, that a better approach to apply adhesive and grout, which approach would reduce the requirement that a contractor use, for instance, a hand trowel, and which approach reduces the amount of time required to apply adhesive and grout, would provide utility.

A search of Patents has identified:

European Patent No. 0 471 863 A1, which describes a system for applying adhesive to a surface of a floor. The 863 Patent describes a system having a tank for receiving adhesive, and includes a mixing tool driven by a geared motor. In use adhesive flows out, under gravity, through an opening in the bottom of the tank and is evenly distributed by a toothed or plain wiper blade.

Other known Patents are:

U.S. Pat. No. 5,947,346 to London which describes an apparatus for spreading asphault.

U.S. Pat. No. 5,254,167 describes an adhesive application apparatus for use in installation of roof panels.

U.S. Pat. No. 4,537,331 describes an apparatus for dispensing viscous materials, said system comprising three wheels, two of which provide support and the third of which controls the clearance of dispensing valves above a floor.

U.S. Pat. No. 3,804,696 describes an applicator car for flowable material, comprising a transversely extending distribution channel.

U.S. Pat. Nos. 2,373,239 to Fenn, 2,645,986 to Rasmussen, and 1,751,565 to Talbott describes spreading systems, and U.S. Pat. No. 1,833,582 to Kavanagh describes a system for use in brick laying.

Even in view of the prior art, need remains for a single system and a method of its use which allows not only quick and easy application of mortar prior to installing tiles and the like, but also quick and easy application of grout thereafter.

DISCLOSURE OF THE INVENTION

The disclosed invention is a system and method applied in the installation of tiles and the like.

The system for installing tiles and the like comprises:

a tank, the inside of said tank being accessible, typically from atop thereof, and having dispensing means located at a lower aspect thereof;

dispensing means control means;

fixed handle means; and transport means;

The fixed handle means is affixed to said tank such that a user can easily access and apply force thereto, and said transport means, (eg. typically comprising at least one wheel), is affixed to said tank such that user application of force to said fixed handle means causes said tank to, via said transport means, move across a substantially flat surface upon which said transport means is positioned, directly atop thereof. The dispensing control means, (eg. a dispensing handle), is affixed to said tank such that a user can easily access and apply force thereto to the end that said dispensing means opens and closes. Importantly, said tank has provision for removably affixing a toothed/smooth or float/wiper element/system thereto. In use a material is placed into said tank and is caused to be distributed over a substantially flat surface by causing said system to, via said transport means, move across said substantially flat surface as a result of the application of force to said fixed handle means, while said control means for opening and closing dispensing means are operated. The end result is that said material is caused to be dispensed and prevented from being dispensed as desired by a user.

Preferred system construction involves 14 gauge steel, and the preferred transport means comprises two wheels, one on each of the left and right sides as the disclosed invention system is observed in elevation from the front thereof.

It is noted that the control means for opening and closing dispensing means located at a lower aspect of said tank, preferably provides means for not only opening and closing the dispensing means, but also means for controlling the amount or degree of its opening.

A method of installing tiles comprising the steps of:

a. providing a substantially flat surface and thereupon providing a system as described above;

b. placing mortar into said system tank and causing said mortar to be distributed over a substantially flat surface by causing said system to, via said transport means, move across a substantially flat surface by application of force to said fixed handle means while operating said control means for opening and closing the dispensing means, to the end that said mortar is caused to be dispensed as desired by a user;

c. installing tiles or the like to said substantially flat surface atop which has been distributed mortar;

d. optionally removing at least most of the mortar remaining present in said system tank and placing grout thereinto, and causing said grout to be distributed over said tiles by causing said system to, via said transport means, move thereacross by application of force to said fixed handle means, while operating said control means for opening and closing said dispensing means, to the end that said grout is caused to be dispensed.

(It is to be appreciated that step d typically is performed at least a day after steps b and c., to give the mortar time to set-up).

Said method preferably further comprises, in step b., causing said tank to comprise a toothed/smooth distribution system/element, and in step d. causing said tank to comprise a float/wiper distribution system at said provision for affixing a toothed/smooth or float/wiper system/element thereto, such that dispensed material is processed thereby to the end it is more optimally spread.

The method of installing tiles and the like further comprises repeating the procedure of causing said grout to be distributed over said tiles by causing said system to, via said transport means, move thereacross by application of force to said fixed handle means while operating said control means for opening and closing dispensing means to the end that said grout is caused to be dispensed as desired.

It is mentioned that while mixing mortar and/or grout in the tank is not forbidden, the present method of installing tiles and the like preferably utilizes mortar and/or grout which is substantially thoroughly mixed and ready for use prior its being placed into he tank.

The disclosed invention will be better understood by reference to the Detailed Description Section of this Specification, in combination with the Drawings.

SUMMARY

It is therefore a purpose and/or objective of the disclosed invention to teach a system for use in installing tiles and the like, in both the mortar and grout dispensing/distribution steps.

It is another purpose and/or objective of the disclosed invention to teach a method for use in installing tiles and the like, in which both mortar and grout dispensing steps are easily and economically accomplished using the same system, with only minor modification thereto to optimize material application.

Other objectives and/or purposes will become apparent upon a reading of the Specification and Claims.

BRIEF DESCRIPTION OF THE DRAWINGS

FIG. 2 shows a top view of the system for installation of tiles and the like.

FIG. 5 shows a bottom view of the system for installation of tiles and the like.

DETAILED DESCRIPTION

Figure 1A:
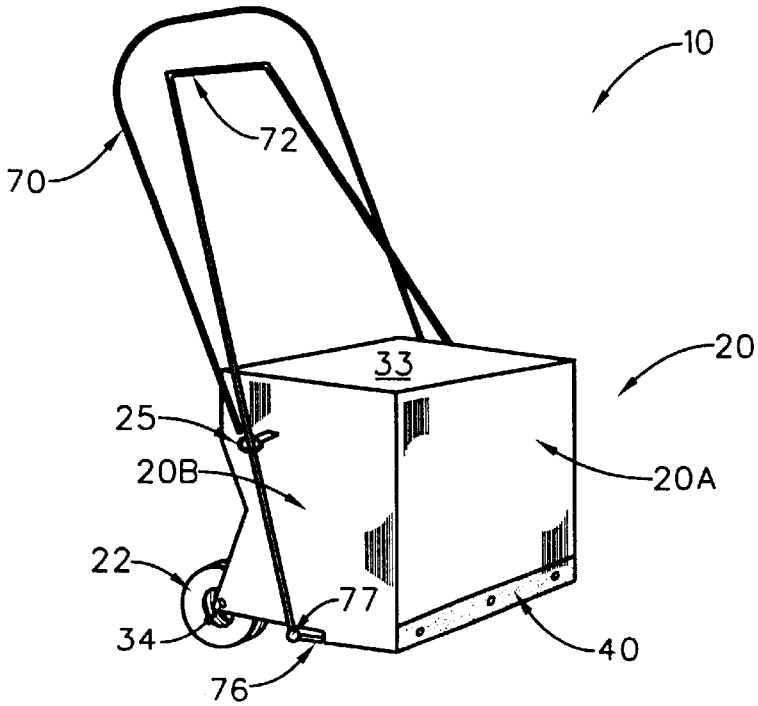
FIG. 1A shows a front perspective view of the system for use in installing tiles and the like with a mortar distribution toothed/smooth element/system affixed thereto.
Figure 1B:
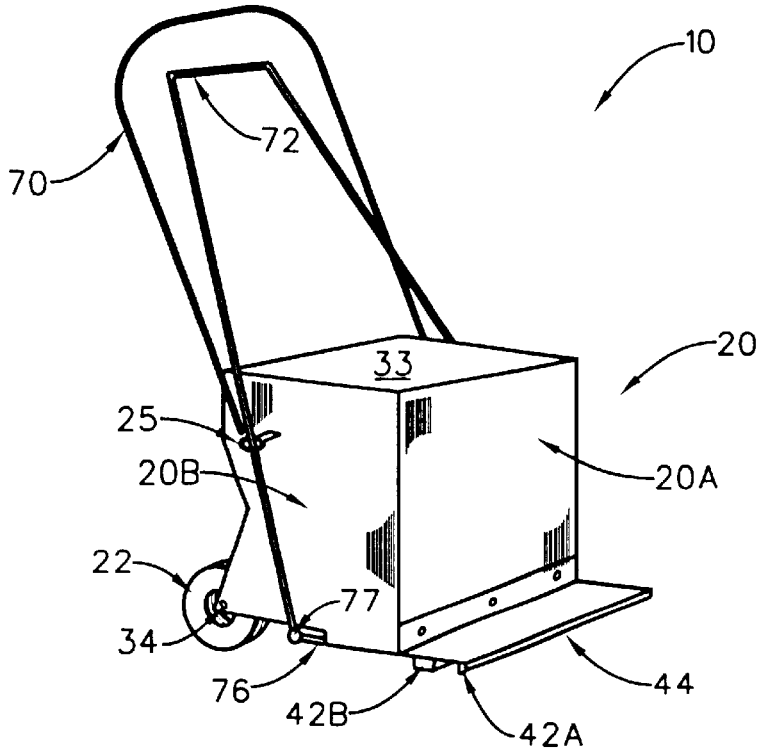
FIG. 1B shows a front perspective view of the system for installation of tiles and the like with a grout distribution float/wiper system affixed thereto.
Figure 2:
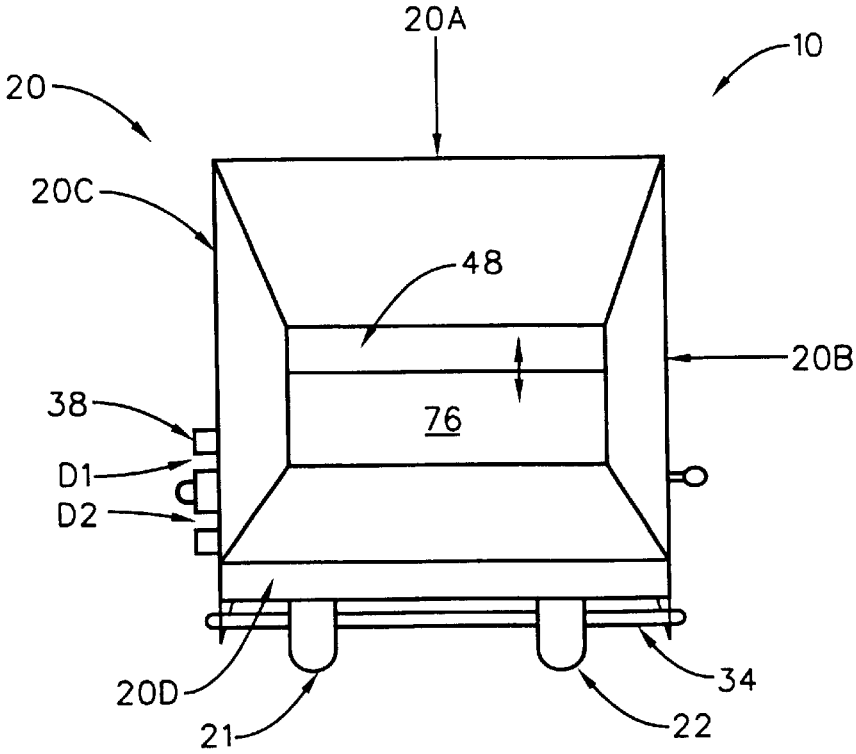
Figure 3:
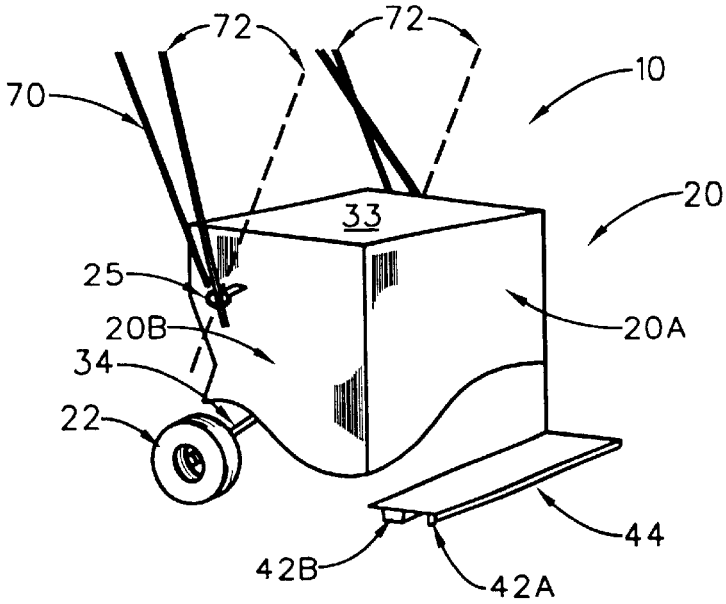
FIG. 3 shows a partially exploded front perspective view of the system for installation of tiles and the like, and demonstrates operation of a dispensing handle.
Figure 5:
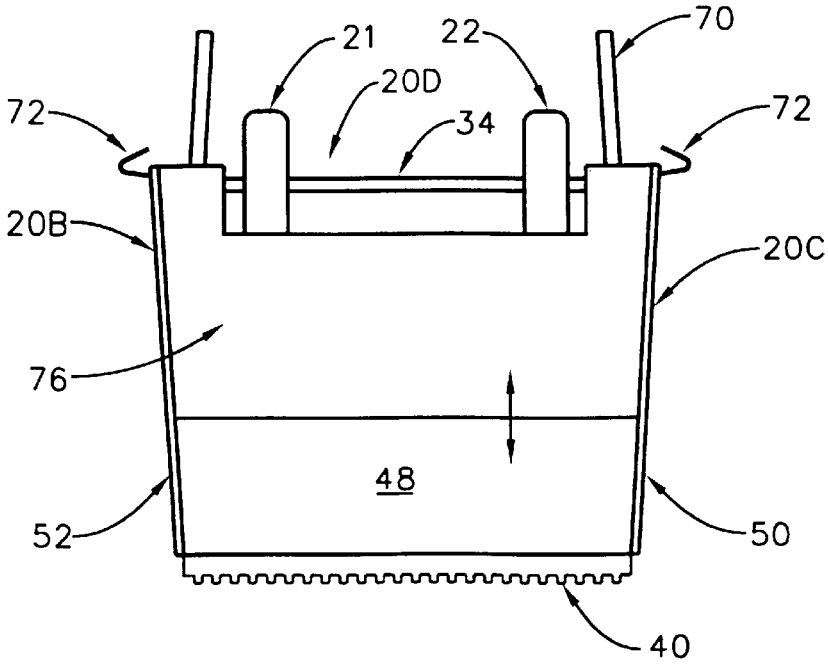

Turning now to FIGS. 1A and 1B, there are shown, in frontal perspective, views of the disclosed invention system for installation of tiles and the like (10). Further, FIGS. 2 and 5 show Top and Bottom Views of said disclosed invention system (10). Note that FIG. 1A demonstrates the presence of a removably affixed Mortar Distribution Toothed Element (40) system, and FIG. 1B demonstrates the presence of a removably affixed Grout Distribution system (44). FIGS. 1A, 1B, 2 and 5 in combination show the presence of a Tank (20), with front (20A), left side (20B), right side (20C) and back wall (20D) elements thereof variously indicated. Also shown are Wheels (21) and (22), Wheel Mounting Rod (34), Fixed Handle (70), (ie. handle means), and Dispensing Handle (72), (ie. dispensing means control means). The Fixed Handle (70) is demonstrated as being firmly affixed to the Tank (20) on Sides (20B) and (20C) thereof, but any functional mounting which allows it to serve as means to cause the system for installation of tiles and the like (10) as a whole to move, is to be considered equivalent. Note that Dispensing Handle (72) is demonstrated as mounted to Tank (20) via mounting means (25) present at Sides (20B) and (20C), which mounting means (25) allow the Dispensing Handle (72) to be moved between two positions, as indicated in FIG. 3 by the presence of Solid and Dashed lines (72). Again, any functional equivalent mounting approach for Dispensing Handle (72) is to be considered equivalent. Continuing, when said Dispensing Handle (72) is moved to the position indicated by the solid line in FIG. 3, a Dispensing Plate (76) viewable in FIGS. 1A, 1B, 2 and 5, to which said Dispensing Handle (72) is rotatably affixed at pivot (77), is positioned to close an opening (48) at the substantially open bottom of the Tank (20) of the system for installation of tiles and the like (10), which opening (48) is viewable in FIGS. 2 and 5. When the Dispensing Handle (72) is moved into the position indicated by the dashed line in FIG. 3, said plate (76) is moved back, (as viewed in FIGS. 1 and 2), so that opening (48) visible in FIGS. 2 and 5 is not obstructed thereby. Dispensing Plate (76), it is to be appreciated, is slidably mounted to the inside of Tank sides (20A) and (20B), at the location shown in FIGS. 1A and 1B. Note that FIGS. 2 and 5 also indicate Dispensing Plate (76) is slidably mounted to allow it to move as indicated by the double headed arrow. It is pointed out that the purpose of causing the opening (48) to be sequentially obstructed and non-obstructed by Dispensing Plate (76) is to, during use, allow a user to control mortar or grout entered to said Tank (20), (via the substantially top (33) thereof), to be sequentially contained in said Tank (20), or dispensed through the non-obstructed opening (48). For instance, when entering mortar or grout into said Tank (20) via the substantially open top (33) thereof, the Dispensing Plate (76) will typically be caused to obstruct opening (48), but when mortar or grout entered to said Tank (20) is to be dispensed, Dispensing Plate (76) will be caused to be moved back, (as viewed in FIGS. 1A and 1B), by operation of Dispensing Handle (72), (to position it as demonstrated by the dashed line (72) in FIG. 3), and provide it flowable access through unobstructed opening (48), as a result of gravity and the weight of said mortar or grout. Again, opening (48), as viewed in FIGS. 2, and 5, is obstructed by Dispensing Plate (76) when Dispensing Handle (72) is positioned as indicated by the solid line (72) in FIG. 3, and provides access therethrough when the Dispensing Handle (72) is positioned as indicted by the dashed line (72) in said FIG. 3. FIG. 5 further demonstrates the described relationship of Dispensing Plate (76) to the opening (48), as viewed from the bottom of the disclosed invention system for installation of tiles and the like (10) and FIG. 5, also indicates Slider Means (50) and (52) on Tank Wall Elements (20C) and (20B), respectively, atop which Dispensing Plate (76) slides in use. Also note that FIG. 2 shows a Dispensing Handle Lock Mechanism (38) which comprises two depressions (D1) and (D2). When present, said Dispensing Handle Lock Mechanism (38) serves to secure Dispensing Handle (72) into a selected position, (eg. indicated by dashed or solid lines (72) in FIG. 3), into which it is positioned by a user. Said Dispensing Handle Lock Mechanism (38), however, allows for relatively easy movement of the Dispensing Handle (72) between being positioned in depressions (D1) and (D2) when said user wishes it to move, to accomplish motion of Dispensing Plate (76).

Figure 4:
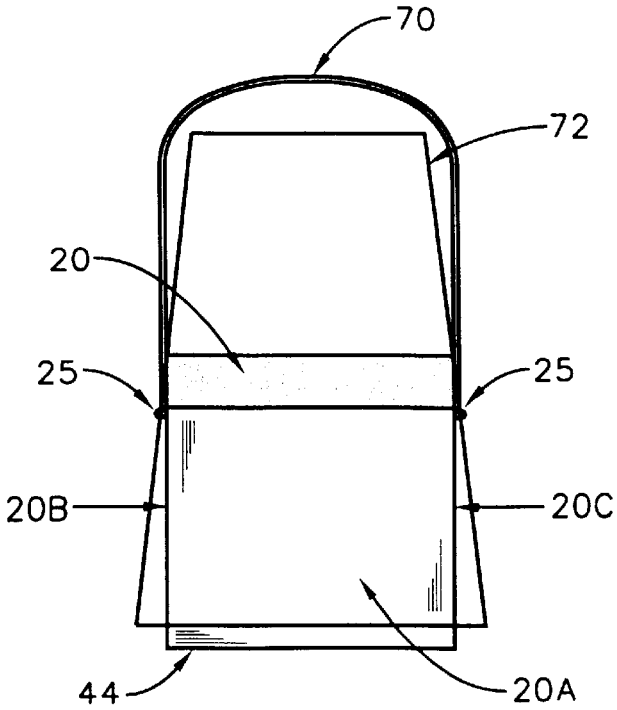
FIG. 4 shows a front elevational view of the relative positioning of the fixed and dispensing handles.

FIG. 4 demonstrates a preferred relationship between Fixed Handle (70) and Dispensing Handle (72), in frontal elevation.

Figure 6:
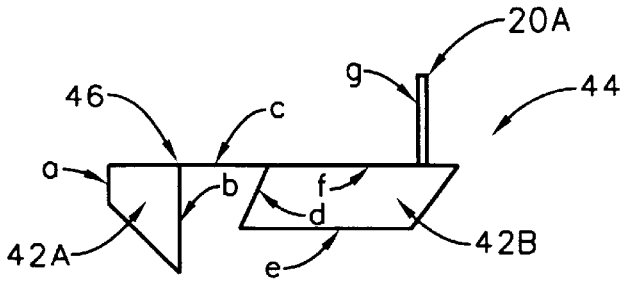
FIGS. 6 and 7 show side elevational views of a grout distribution float/wiper system.
Figure 7:
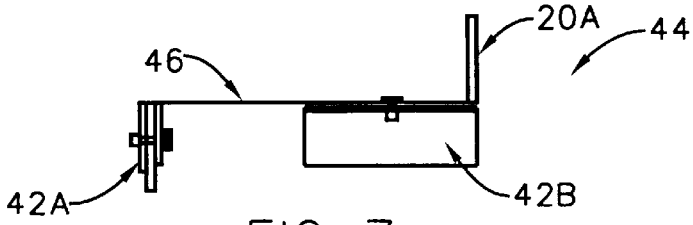

FIGS. 6 and 7 show side elevational views of a Grout Distribution system (44) indicated in FIG. 1B in frontal perspective. Note the presence of float (42B) and Wiper (42A) elements. In use, the float element (42B) serves to urge grout between tiles or the like, while element (42A) serves to wipe the excess grout from the surface of said tiles or the like. FIG. 6 demonstrates relatively permanent affixation to a base element (46), and FIG. 7 demonstrates removable affixation, to allow replacement of said Wiper (42A) and Float (42B). This is to facilitate replacement of elements which require replacement periodically. It is noted that Float element (42) is typically made of a rigid structural material such as steel or plastic, to which is sequentially bonded molded and gum rubber elements.

Figure 8A:
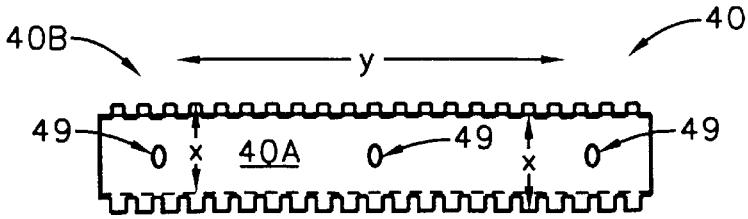
FIG. 8A shows a front view of the a dual toothed element system for use in distributing mortar.
Figure 8B:
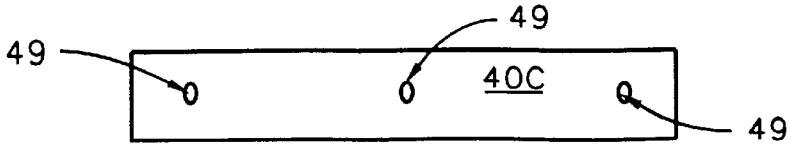
FIG. 8B shows that the element system for use in distributing mortar need not necessarily have teeth present, but can be smooth.

FIG. 8A demonstrates a dual Mortar Distribution Toothed Element (40) system, with one Toothed Element (40A) being positioned directly in front of a second Toothed Element (40B). Both Toothed Elements (40A) and (40B) have Mounting Holes (49) present therein for allowing mounting to Tank (20) as shown in FIG. 1A. The mounting holes are preferably of a vertically elongated shape as shown, to allow adjustable mounting to Tank (20). The presence of two Toothed Elements (40A) and (40B) allows setting an effective Tooth Depth in each by relative upward/downward motion therebetween. Further, the Teeth in the two Toothed Elements (40A) (40B) typically will be formed with different dimensions and separations to provide a user a choice. For example Teeth and notches might appropriate for dispensing mortar in lines which are ¼ by ¼ inch or perhaps ¼ by ⅜ inch or ¼ by ½ inch in dimension. It is noted that Toothed Elements (40A) and (40B) being removably affixed to the Tank (20), can be replaced when required. FIG. 8B shows that the Mortar Distribution Element (40) system for use in distributing mortar need not necessarily have teeth present, but as shown by (40C), can have a smooth, instead of toothed, side. Further, a dual element system can include a toothed (40A) or (40B) and smooth (40C) element instead of two toothed elements (40A) (40B) as shown in FIG. 8A.

Figure 9A:
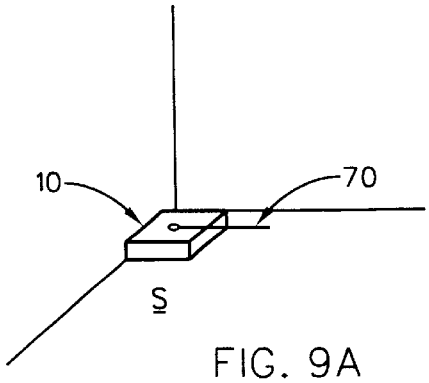
FIGS. 9A–9E demonstrate steps in the Method of the disclosed invention.
Figure 9B:
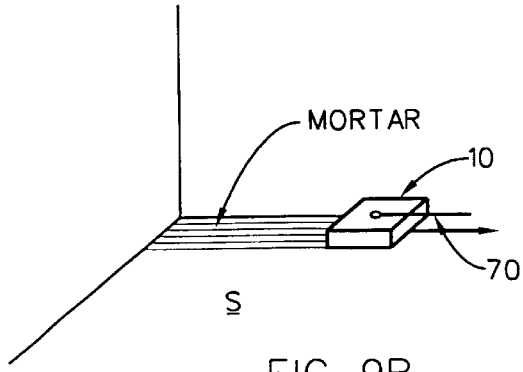
Figure 9C:
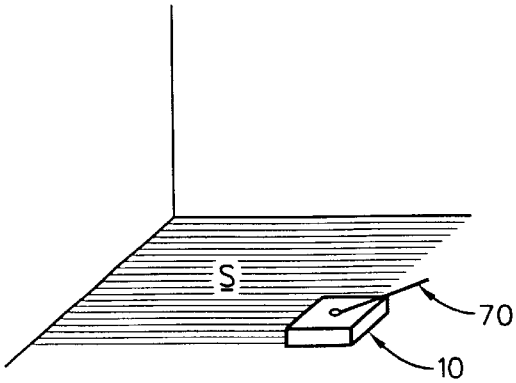
Figure 9D:
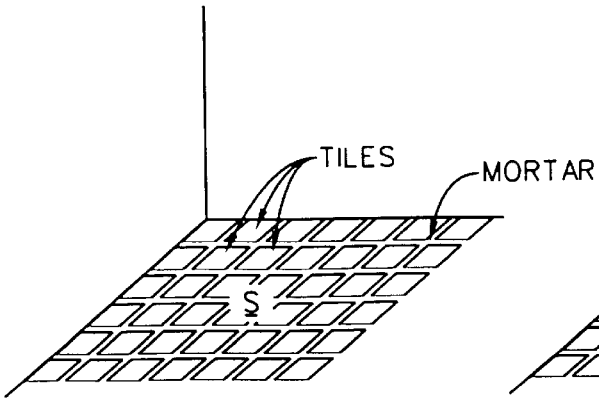
Figure 9E:
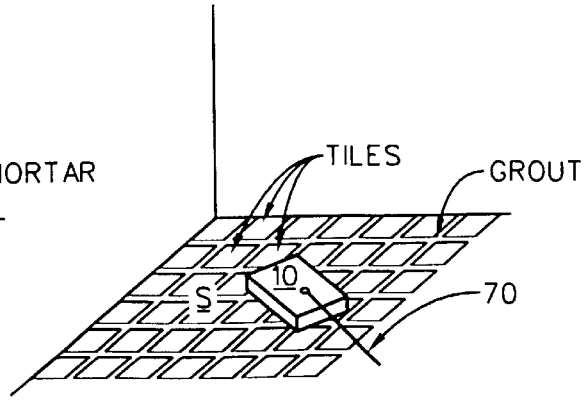

Turning now to FIGS. 9A–9*e*, there are shown various steps in the practice of the disclosed invention Methodology, using a generic representation of the disclosed invention system for installation of tiles and the like (10). FIG. 9A shows that a substantially flat surface (S) is provided with a disclosed invention system for installation of tiles and the like (10), (shown generically as a box, and assumed to have the Toothed Element (40A) (40B) present thereupon, (alternatively a smooth element (40C) could be present), as demonstrated in FIG. 1A), and which is to be considered as filled with ready to apply mortar. FIG. 9B shows that (10) has been moved in a first row while mortar was dispensed, (ie. Dispensing Handle (72) was positioned as shown by dashed line in FIG. 3 as described above). FIG. 9C shows the situation after system (10) is moved, while dispensing mortar, to form many rows. Note that when mortar dispensing in a row is finished, mortar dispensing is preferably ended, (by operation of Dispensing Handle (72) to the position indicated by the solid line (72) in FIG. 3 as described above), until a new row is started. FIG. 9D shows that tiles have been placed atop the distributed mortar, but that grout has not yet been applied. FIG. 9E shows the disclosed invention system for installation of tiles and the like (10) in the process of dispensing grout. It is assumed that a float/wiper containing Grout Distribution system (44) is assumed present on the disclosed invention system for installation of tiles and the like (10), as shown in FIG. 1B, when the step indicated by FIG. 9E is practiced. It is noted that while application of mortar is typically done in rows, grout can be applied along a path oriented 45 degrees to a wall, or along a path using somewhat random path motion of the present invention system (10). Importantly, regarding the methodology of the present invention, the same system for installation of tiles and the like (10) is used in the steps portrayed in FIGS. 9B, 9C and 9E.

While not limiting, note that FIGS. 6, 7 and 8A have various lower case letters present therein near various structural lengths. Typical non-limiting lengths for the structure lengths indicated thereby are:

a—⅝ inch;
b—¾ inch;
c—1¼ inches;
d—⅝ inch;
e—2 inches;
f—4 inches;
g—2 inches;
x—11 inches;
y—2.25 inches.

Further, typical non-limiting Tank (20) dimensions are:

11 inches wide;
11 inches deep;
13 inches high;

and the opening (48) at the bottom of the system for installation of tiles and the like (10) is typically, though not limited to being 4 deep inches by 11 inches wide.

The Fixed (70) and Dispensing (72) Handles are both of a length which provides locates their upper aspects conveniently for a user to access.

It is noted that the dispensing means located at a lower aspect of said tank is, while not limited thereto, preferably caused to be about one-eighth (⅛) inch, (ie. less than a half (½) inch), above the substantially flat surface (S) in use, by the construction of the disclosed system, (eg. mounting of the wheels and the toothed/smooth or float/wiper element/system. A ⅛ inch spacing causes the weight of mortar in the tank, (eg. 50 pounds), to be directly applied to the substantially flat surface, and said mortar weight per se. forces the mortar being dispensed into crack and gap like irregularities in said substantially flat surface.

In view of the foregoing Disclosure, it should be appreciated that use of the presently disclosed invention allows a user to avoid the stress associated with conventional approaches to dispensing mortar and grout, on his or her back and knees. In addition it is noted that use of the disclosed system has been found to decrease the time required to spread mortar and/or grout by at least five times.

Having hereby disclosed the subject matter of the present invention, it should be obvious that many modifications, substitutions, and variations of the present invention are possible in view of the teachings. It is therefore to be understood that the invention may be practiced other than as specifically described, and should be limited in its breadth and scope only by the Claims.

I claim:

1. A method of installing tiles and the like comprising the steps of:

a. providing a substantially flat surface and thereupon providing a system comprising a tank, said tank having a fixed handle means and at least one substantially flat surface contacting transport means affixed thereto, and further having a dispensing means control means for opening and closing dispensing means located at a lower aspect of said tank, said tank having provision for affixing a toothed/smooth or float/wiper element/system thereto;

such that in use said tank can have material to be dispensed placed thereinto and a user can, by application of force to said fixed handle means, cause said tank to, via said transport means, move across said substantially flat surface while operating said dispensing means control means to the end that material caused to be present in said tank is, as desired and directed by said operator, caused to be dispensed;

b. placing mortar into said tank and causing said mortar to be distributed over a substantially flat surface by causing said system to, via said transport means, move across said substantially flat surface by application of force to said fixed handle means while operating said dispensing means control means for opening and closing the dispensing means, to the end that said mortar is caused to be dispensed;

c. installing tiles or the like to said substantially flat surface atop which has been distributed mortar; and d. placing grout into said tank and causing said grout to be distributed over said tiles or the like by causing said system to, via said transport means, move thereacross by application of force to said fixed handle means while operating said dispensing means control means for opening and closing said dispensing means, to the end that said grout is caused to be dispensed.

2. A method of installing tiles and the like as in claim 1, in which the dispensing means located at a lower aspect of said tank is caused to be positioned about one-eighth inch above the substantially flat surface in step b.

3. A method of installing tiles and the like as in claim 1, which further comprises, in step b., causing said tank to comprise a toothed/smooth distribution element/system, and in step d causing said tank to comprise a float/wiper distribution element/system at said provision for affixing a toothed/smooth or float/wiper element/system thereto.

4. A method of installing tiles and the like as in claim 1, in which in step a. providing of a dispensing means control means for opening and closing dispensing means located at a lower aspect of said tank, involves providing means for not only opening and closing the dispensing means, but also means for controlling the amount or degree of its opening.

5. A method of installing tiles and the like as in claim 1, which method further comprises repeating the procedure of causing said grout to be distributed over said tiles by causing said system to, via said transport means, move thereacross by application of force to said fixed handle means while operating said dispensing means control means for opening and closing the dispensing means to the end that said grout is caused to be dispensed.

6. A method of installing tiles and the like as in claim 1, in which the placing of mortar and/or grout into said tank involves mortar and/or grout which is substantially thoroughly mixed and ready for use prior its being placed thereinto, there being substantially no intentionally caused mixing of mortar and/or grout in said tank.

7. A method of installing tiles and the like comprising the steps of:

a. providing a substantially flat surface and thereupon providing a system comprising a tank, said tank having a fixed handle means and at least one substantially flat surface contacting wheel affixed thereto, and further having a dispensing means control means for opening and closing dispensing means located at a lower aspect of said tank, said tank having provision for affixing a toothed/smooth or float/wiper element/system thereto;

such that in use said tank can have material to be dispensed placed thereinto and a user can, by application of force to said fixed handle means, cause said tank to, via said at least one flat surface contacting wheel, move across said substantially flat surface while said dispensing means control means is operated to the end that material caused to be present in said tank is, as desired and directed by said operator, caused to be dispensed;

b. causing said tank to comprise a toothed/smooth distribution element/system at said provision for affixing a toothed/smooth or float/wiper element/system thereto, and placing mortar into said tank and causing said mortar to be distributed over a substantially flat surface by causing said system to, via said at least one flat surface contacting wheel, move across a substantially flat surface by application of force to said fixed handle means while operating said dispensing means control means for opening and closing the dispensing means, to the end that said mortar is caused to be dispensed and spread by said toothed/smooth distribution element/system;

c. installing tiles or the like to said substantially flat surface atop which has been distributed mortar;

d. removing said toothed/smooth distribution element/system and causing said tank to comprise a float/wiper distribution element/system at said provision for affixing a toothed/smooth or float/wiper element/system thereto; optionally removing at least most of the mortar remaining present in said tank and placing thereinto grout, and causing said grout to be distributed over said tiles by causing said system to, via said at least one flat surface contacting wheel, move thereacross by application of force to said fixed handle means while operating said dispensing means control means for opening and closing said dispensing means, to the end that said grout is caused to be dispensed and distributed into regions between said installed tiles or the like by said float/wiper element/system.

8. A method of installing tiles and the like as in claim 7, in which the placing of mortar and/or grout into said tank involves mortar and/or grout which is substantially thoroughly mixed and ready for use prior its being placed thereinto, there being substantially no intentionally caused mixing of mortar and/or grout in said tank.

9. A system for installing tiles and the like comprising:

a tank, the inside of said tank being accessible from atop thereof and having dispensing means located at a lower aspect thereof;

dispensing means control means;

fixed handle means; and at least one wheel;

said fixed handle means being affixed to said tank such that a user can easily access and apply force thereto, and said at least one wheel being affixed to said tank such that user application of force to said fixed handle means causes said tank to, via said at least one wheel, move across a substantially flat surface which said at least one wheel sit atop, said dispensing means control means being affixed to said tank such that a user can easily access and apply force thereto to the end that said dispensing means opens and closes; said tank having provision for affixing a toothed/smooth or float/wiper element/system thereto;

such that in use a user causes a toothed/smooth or float/wiper element/system to be affixed to said tank, places material into said tank and causes said material to be distributed over a substantially flat surface by causing said system to, via said at least one wheel which sits atop thereof, move across said substantially flat surface by application of force to said fixed handle means while operating said dispensing means control means for opening and closing dispensing means, to the end that said material is caused to be dispensed and spread by said toothed/smooth or float/wiper element/system.

10. A system for installing tiles and the like to a surface as in claim 9, in which the tank is made of 14 gauge steel.

11. A system for installing tiles and the like comprising:

a. a Tank (20) comprising:

front wall (20A);

left side (20B);

right side (20C);

back wall (20D); and substantially open top (33) and bottom (48);

wheels (21) and (22);

fixed handle (70);

dispensing handle (72);

dispensing plate (76);

means for affixing a toothed/smooth (40) or float/wiper (44) element/system thereto;

said wheels (21) and (22) being rotatably affixed to said tank at the back and bottom thereof;

said dispensing plate being slidably mounted at the bottom of said tank (20) such that it can be positioned to either not obstruct the open bottom of said tank, or effectively close said the bottom of said tank;

said dispensing handle (72) being mounted to Tank (20) via mounting means (25) at Sides (20B) and (20C) and via rotation pivot (77) to said dispensing plate (76), which mounting means (25) allow said dispensing handle to be moved between two positions, said two position corresponding to positioning said dispensing plate into dispensing and non-dispensing positions, which dispensing and non-dispensing positions correspond to not obstructing the open bottom of said tank, and effectively closing said the bottom of said tank;

said fixed handle being affixed to said system for installing tiles and the like such, that setting said system for installing tiles and the like on a substantially flat surface and applying force to said fixed handle causes it to move on said substantially flat surface via said wheels (21) and (22);

said system for installing tiles and the like further comprising, at the lower aspect of the front wall (20A), a selection from the group consisting of:

at least one toothed/smooth element/system (40A) (40B) (40C); and a float/wiper element/system (44);

such that in use a user causes a toothed/smooth element/system (40A) (40B) (40C) or float/wiper system (44) to be affixed to the bottom of front wall (20A) of said tank (20) via means for affixing a toothed/smooth (40) or float/wiper (44) element/system thereat; places material into said tank (20) while said dispensing handle is positioned to place said dispensing plate (76) into a closed position, and then causes said material to be distributed over a substantially flat surface by causing said system (10) to, via said wheels (21) and (22) which sits atop of said substantially flat surface, move across it by application of force to said fixed handle (70) while operating said dispensing handle (72) to cause it to move said dispensing plate (76) into a dispensing position, to the end that said material is caused to be dispensed from said tank (20), and is spread by said selected toothed/smooth element/system (40A) (40B) or float/wiper element/system (44).

12. A system for installing tiles and the like as in claim 11, which further comprises a dispensing handle lock mechanism (38) mounted on the left side (20B) or right side (20C) of said tank (20), said dispensing handle lock mechanism (38) comprising two dispensing handle sized depressions, which dispensing handle lock mechanism (38) serves to secure said dispensing handle (72) into a non-dispensing or dispensing position when so placed, but which allows for substantially easy movement thereof when a user wishes it to move.

13. A system for installing tiles and the like as in claim 11, in which construction thereof causes the dispensing plate which is slidably mounted at the bottom of said tank (20), is caused to be positioned between one-eighth and one-half an inch above the substantially flat surface during use to spread mortar.

14. A method of installing tiles and the like comprising the steps of:

a. providing a system for installing tiles and the like comprising:

a. a Tank (20) comprising:

front wall (20A);

left side (20B);

right side (20C);

back wall (20D); and substantially open top (33) and bottom (48);

wheels (21) and (22);

fixed handle (70);

dispensing handle (72);

dispensing plate (76);

means for affixing a toothed/smooth (40) or float/wiper (44) element/system thereto;

said wheels (21) and (22) being rotatably affixed to said tank at the back and bottom thereof;

said dispensing plate being slidably mounted at the bottom of said tank (20) such that it can be positioned to either not obstruct the open bottom of said tank, or effectively close said the bottom of said tank;

said dispensing handle (72) being mounted to Tank (20) via mounting means (25) at Sides (20B) and (20C) and via rotation pivot (77) to said dispensing plate (76), which mounting means (25) allow said dispensing handle to be moved between two positions, said two position corresponding to positioning said dispensing plate into dispensing and non-dispensing positions, which dispensing and non-dispensing positions correspond to not obstructing the open bottom of said tank, and effectively closing said the bottom of said tank;

said fixed handle being affixed to said system for installing tiles and the like such, that setting said system for installing tiles and the like on a substantially flat surface and applying force to said fixed handle causes it to move on said substantially flat surface via said wheels (21) and (22);

said system for installing tiles and the like further comprising, at the lower aspect of the front wall (20A), a selection from the group consisting of:

at least one toothed/smooth element/system (40A) (40B) (40C); and a float/wiper element/system (44);

such that in use a user causes a toothed/smooth element/system (40A) (40B) (40C) or float/wiper system (44) to be affixed to the bottom of front wall (20A) of said tank (20) via means for affixing a toothed/smooth (40) or float/wiper (44) element/system thereat; places material into said tank (20) while said dispensing handle is positioned to place said dispensing plate (76) into a closed position, and then causes said material to be distributed over a substantially flat surface by causing said system (10) to, via said wheels (21) and (22) which sits atop of said substantially flat surface, move across it by application of force to said fixed handle (70) while operating said dispensing handle (72) to cause it to move said dispensing plate (76) into a dispensing position, to the end that said material is caused to be dispensed from said tank (20), and is spread by said selected toothed/smooth element/system (40A) (40B) (40C) or float/wiper element/system (44);

b. causing said tank (20) to comprise a toothed/smooth element/system (40A) (40B) (40C) at said provision for affixing a toothed/smooth or float/wiper element/system thereto, and placing mortar into said tank (20) and causing said mortar to be distributed over a substantially flat surface by causing said system (10) to, via said surface contacting wheels (21) (22), move across said substantially flat surface by application of force to said fixed handle (70) while operating said dispensing handle (72) for moving dispensing plate (76) to open and close the substantially open bottom, to the end that said mortar is caused to be dispensed and spread by said toothed/smooth element/system (40A) (40B) (40C);

c. installing tiles or the like to said substantially flat surface atop which has been distributed mortar;

d. removing said toothed/smooth element/system (40A) (40B) (40C) and causing said tank (20) to comprise a float/wiper system (44) at said provision for affixing a toothed/smooth or float/wiper element/system thereto; optionally removing at least most of the mortar remaining present in said tank (20) and placing thereinto grout, and causing said grout to be distributed over said tiles by causing said system (10) to, via said flat surface contacting wheels (21) (22), move thereacross by application of force to said fixed handle (70) while operating said dispensing handle (72) for moving dispensing plate (76) to open and close the substantially open bottom, to the end that said grout is caused to be dispensed and distributed into regions between said installed tiles or the like by said float/wiper system (44).

* * * * *